US011118744B2

(12) United States Patent
Papineau et al.

(10) Patent No.: US 11,118,744 B2
(45) Date of Patent: Sep. 14, 2021

(54) DEVICE FOR LIGHTING A COURT AND CORRESPONDING LIGHTING STRIP

(71) Applicant: NLX, La Chapelle Vendomoise (FR)

(72) Inventors: Jérôme Papineau, Blois (FR); Jean-Luc Tournebise, Blois (FR)

(73) Assignee: NLX, La Chapelle Vendomoise (FR)

( * ) Notice: Subject to any disclaimer, the term of this patent is extended or adjusted under 35 U.S.C. 154(b) by 0 days.

(21) Appl. No.: 16/649,051

(22) PCT Filed: Sep. 20, 2018

(86) PCT No.: PCT/FR2018/000220
§ 371 (c)(1),
(2) Date: Mar. 19, 2020

(87) PCT Pub. No.: WO2019/058035
PCT Pub. Date: Mar. 28, 2019

(65) Prior Publication Data

US 2020/0224840 A1 Jul. 16, 2020

(30) Foreign Application Priority Data

Sep. 22, 2017 (FR) ..... 1771006

(51) Int. Cl.

| | |
|---|---|
| ***F21S 8/08*** | (2006.01) |
| ***F21S 2/00*** | (2016.01) |
| ***F21Y 103/10*** | (2016.01) |
| ***F21Y 115/10*** | (2016.01) |
| ***F21W 131/105*** | (2006.01) |

(52) U.S. Cl.
CPC ..... *F21S 8/086* (2013.01); *F21S 2/005* (2013.01); *F21S 8/081* (2013.01); *F21W 2131/105* (2013.01); *F21Y 2103/10* (2016.08); *F21Y 2115/10* (2016.08)

(58) Field of Classification Search
CPC ..... F21V 19/0045; F21W 2131/105; F21Y 2103/10; F21Y 2115/10; F21S 8/086; F21S 8/081; F21S 2/005; F21S 8/08; F21S 8/085; F21S 8/088
See application file for complete search history.

(56) References Cited

U.S. PATENT DOCUMENTS 4,141,056 A 2/1979 Neely
4,270,161 A 5/1981 Perretta
(Continued)

FOREIGN PATENT DOCUMENTS

WO 2011055973 A2 5/2011

OTHER PUBLICATIONS

International Search Report; priority document.

*Primary Examiner* — Joseph L Williams
*Assistant Examiner* — Jose M Diaz
(74) *Attorney, Agent, or Firm* — Greer, Burns & Crain, Ltd.

(57) ABSTRACT

A device for lighting a court including at least one lighting strip extending substantially horizontally along at least one side of the court, at a predefined height relative to the court. The strip comprises a series of light sources distributed along its length, each of the light sources projecting a light beam with a diffusion angle that is less than 20°, oriented perpendicular to the longitudinal direction of the strip.

14 Claims, 4 Drawing Sheets

(56) References Cited

U.S. PATENT DOCUMENTS

2013/0058090 A1* 3/2013 Ferrie ..... G09F 13/0409
362/249.02
2013/0250556 A1* 9/2013 Gordin ..... F21V 21/30
362/147

* cited by examiner

DEVICE FOR LIGHTING A COURT AND CORRESPONDING LIGHTING STRIP

CROSS-REFERENCES TO RELATED APPLICATIONS

This application claims the benefit of the International Application No. PCT/FR2018/000220, filed on Sep. 20, 2018, and of the French patent application No. 1771006 filed on Sep. 22, 2017, the entire disclosures of which are incorporated herein by way of reference.

FIELD OF THE INVENTION

The present invention relates to a device for lighting a court, and more particularly to a lighting device that is specifically suitable for courts for playing sports.

Such a device particularly applies to lighting outdoor courts.

The invention also relates to a lighting strip that can be implemented in such a lighting device.

BACKGROUND

Playing a sport on a dedicated court usually requires good visibility. For sports that are played under the organization of a federation, more often than not this federation regulates the characteristics of the court on which the sport is played. It can therefore stipulate precise dimensions for the court, as well as other characteristics, such as the characteristics relating to the lighting of the court. This is the case, for example, in tennis federations, which stipulate, based on standards, the dimension of the tennis courts and, for courts which need to be used at night or without natural light, the lighting characteristics, and, in particular, the lighting intensity at the different points on the court and the uniformity of this lighting across the court.

For indoor courts, the lighting devices comprise lamps or spotlights that are generally fixed to the ceiling or to the structure of the building, in order to correctly light the courts.

For outdoor courts, these are usually lit by lamps or spotlights positioned at the top of supporting masts which are installed around the sides of the court, as disclosed in U.S. Pat. No. 4,141,056, for example. These supporting masts need to be very tall in order to allow the spotlights to have a sufficient distance to uniformly light the court.

For sports that require the athletes or players to look up, such as tennis, the spotlights lighting the courts may be a source of dazzling or flashes of light. A flash of light is produced when a light source, without necessarily dazzling someone, produces a persistent light image in their eyes, which can be a particular nuisance when playing sports. The use of spotlights located high up makes it possible to limit this drawback by allowing the spotlights to only be aligned with the line of sight of the player in a reduced number of cases.

Once the spotlights are mounted on the masts, it is necessary for the orientation thereof to be adjusted, at night, by a first engineer, who is assisted by a second engineer who is on the court to measure the lighting intensity at different points on the court. The precision required for this adjustment is all the more important when the height of the mast supporting the spotlights is low. When the lighting has a lower angle of incidence relative to the lit court, it is more difficult to achieve uniform lighting that complies with the regulations.

Lighting devices are therefore usually set up with very high masts, in order to obtain satisfactory lighting uniformity and to limit dazzling of the players. The installation of these supporting masts, which must be sufficiently robust in order to withstand wind, is a significant, expensive task that generally requires a building permit to be obtained, and this may sometimes be beyond the abilities of the owners of courts for playing sports. A large number of outdoor courts, and in particular tennis courts, are therefore not lit and can only be used during the day.

Moreover, on lit courts, the spotlights located on the supporting masts require a significant amount of power, which thus results in high consumption of electricity. In addition, these spotlights often generate significant light pollution, by lighting the area surrounding the court when this is not desired.

In order to avoid the significant expense linked to the installation of spotlights supported by masts, some tennis courts are lit by fluorescent tubular strips extending along the courts, which may be supported by the fence posts of the court or by a dedicated structure, as found in U.S. Pat. No. 4,270,161. Owing to the nature of the light sources and the proximity between the strips and the court, the light cannot be distributed over the court with the desired level of intensity and uniformity. Such a device therefore, for example, does not make it possible to meet the criteria imposed by tennis federations for courts that host official competitions. In addition, the lighting provided by these strips is often a source of dazzling or flashes of light for the players.

SUMMARY OF THE INVENTION

A problem addressed by the present invention is to overcome these drawbacks from the prior art.

More particularly, a problem addressed by the present invention is to provide a lighting device for a court, and more particularly for a court for playing sports, which involves lower installation costs compared with the lighting solutions that are generally used.

Another problem addressed by the present invention is to provide such a lighting device which provides a high level of lighting uniformity, which thus meets stringent prescriptive requirements.

Another problem addressed by the present invention is to provide such a lighting device of which the installation and adjustment are simplified compared with the solutions from the prior art.

Yet another problem addressed by the present invention is to provide such a lighting device which is well suited to playing the sport in question, and in particular which, as far as possible, limits the risks of the athletes or players being dazzled or experiencing flashes of light, and which limits the shadows cast on the court.

These problems, as well as others which will become clearer in the following, are solved by means of a device for lighting a court, the device comprising at least one lighting strip extending horizontally along at least one side of the court, wherein, according to the invention, the strip comprises a series of light sources distributed along its length, each of the light sources projecting a light beam having a diffusion angle that is less than 20°, oriented perpendicularly to the longitudinal direction of the strip.

In the present application, the strip can be considered to extend horizontally if it has an angle of less than 5° to the horizontal. Likewise, the beam can be considered to be oriented perpendicularly to the longitudinal direction of the strip if it has an angle of less than 5° to the perpendicular. Moreover, in accordance with the uses in the field of lighting, the diffusion angle of a light beam is considered to be the diffusion angle of the full width at half maximum (FWHM) of the beam, i.e., the width of the beam at which the light intensity is at least equal to the maximum intensity.

Such a device having a strip of highly directional light sources that are oriented in parallel with one another makes it possible to efficiently light a court, even when the strip is placed at a low height, without dazzling persons on the court if they are not facing the strip. This device is therefore well suited to lighting courts for playing sports, particularly courts intended for playing sports in which the players or athletes are mainly facing in a preferred direction. In the latter case, the lighting strip(s) may preferably be parallel to this preferred direction.

Advantageously, the strip, or at least one of the strips, may be positioned at a predefined height relative to the court. This height may, for example, be predefined when the courts have standardized dimensions, and the strip may be fixed to an element of the court, such as the fences around the court.

Advantageously, this height of the strip is relatively low compared with the dimensions of the court to be lit, such that the beams from the light sources are preferably oriented in directions having angles of less than 25° to the horizontal. The low-angled lighting of the court that is produced thus makes it possible to avoid dazzling the players and to minimize the power consumption.

Preferably, the strip extends over the majority of the length of the side of the court. This arrangement makes it possible for the strip to effectively light the entire useful portion of the court.

Preferably, the device comprises at least two lighting strips, facing one another along two opposite, parallel sides of the court. These two lighting strips, in particular, make it possible to obtain improved lighting uniformity and to limit the shadows that are cast.

According to a preferred embodiment, the orientation of the light sources relative to the strip(s) is invariable. This solution, which can be implemented in order to light courts having predefined dimensions, simplifies the installation of the device, with the orientations of the light sources being adjusted in advance and not being provided such that they can be modified during or after installation.

Preferably, the position of the strip(s) relative to the court is predetermined on the basis of the dimensions of the court and the properties of the desired lighting.

Advantageously, the strip or at least one of the strips has means for fixing to posts located along the side of the court. The strips can thus be easily joined to pre-existing elements on the court.

According to a preferred embodiment, the fixing means comprise rails which extend over the entire length of the strip and are suitable for holding a fixing element at any point along the length of the strip. These fixing means thus make it possible to easily fix the strips to posts, irrespective of the position or spacing of the posts.

Preferably, the strip or at least one of the strips is formed by a plurality of separate strip segments which are joined to one another.

In this case, advantageously, the strip segments are joined by fixing elements held by the rails of each of the strip segments.

According to an advantageous embodiment, the light sources of the strip or at least one of the strips are oriented in at least two different directions. These different orientations of the strips make it possible to ensure that the light is well distributed over the court.

Advantageously, the strip or at least one of the strips has at least two separate supports suitable for receiving each of the light sources that are oriented in parallel in a predetermined direction.

Preferably, each of the supports extends over the entire length of the strip or at least one of the strips. The light sources may thus be distributed in several orientations over the entire length of the strip.

According to a preferred embodiment, the strip or at least one of the strips comprises a metal profile member comprising the fixing means and at least one planar surface forming a support that is suitable for receiving light sources that are oriented in parallel in a predetermined direction. Such a metal profile member has good mechanical properties. It may also participate effectively in dispersing the heat emitted by the light sources.

According to an advantageous embodiment, the device comprises at least two lighting strips that extend substantially in parallel with one another along the same side of the court, the light sources of at least two of the strips being oriented in different directions, which are perpendicular to the longitudinal direction of the strips. Secondary lighting strips may thus ensure, in certain parts of the court, that useful areas for playing the sport in question are lit.

Advantageously, the light sources are lamps comprising light-emitting diodes.

The invention also relates to a lighting strip suitable for being implemented in a lighting device as described above, having fixing means suitable for allowing it to be fixed to posts in a horizontal position, the fixing means comprising rails which extend over the entire length of the strip and are suitable for holding a fixing element at any point along the length of the strip, the lighting strip comprising a series of light sources distributed along its length, each of the light sources projecting a light beam having a diffusion angle that is less than 20°, oriented perpendicularly to the longitudinal direction of the strip, part of the light sources having a first, non-modifiable orientation relative to the strip, and another part of the light sources having a second orientation, which is different from the first orientation and is non-modifiable, relative to the strip.

This lighting strip may advantageously have one or more of the above-mentioned features.

BRIEF DESCRIPTION OF THE DRAWINGS

The invention will be better understood upon reading the following description of preferred embodiments, which is provided merely by way of representative, non-limiting example and is accompanied by drawings in which.

DETAILED DESCRIPTION OF THE PREFERRED EMBODIMENTS

Tennis Court

Figure 1:
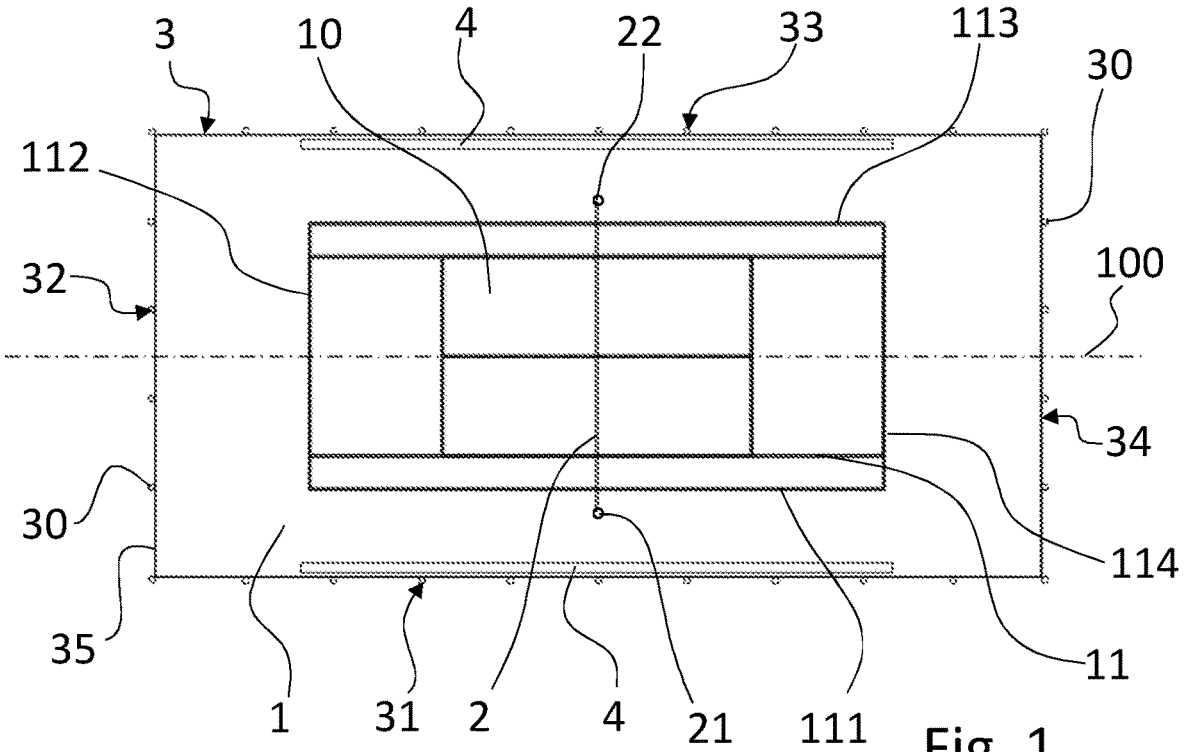
FIG. 1 is a plan view of a court for playing tennis.

FIG. 1 is a plan view of a court for playing tennis. This court is also shown in a perspective view in FIG. 2. It has been constructed and fitted out in accordance with the prescriptive requirements imposed by tennis federations in order for it to be possible to host competitions.

This court has a surface 1, on which lines 11 have been painted in white paint. The rectangular surface area surrounded by lines 11 forms the playing area 10, or court. The playing area 10 is divided into two by a net 2 tensioned between two vertical posts 21 and 22, arranged on either side of the playing area 10. The lines 11 and the net 2 define the main axis 100 of the court, which extends perpendicularly to the plane defined by the net 2 by dividing the playing area 10 into two equal parts.

The outer side lines 111 and 113 of the playing area, which are parallel to the main axis 100 of the court and are the furthest from this axis, form the lateral limits of the playing area 10. The court baselines 112 and 114, which are parallel to the net 2 and are the furthest from this net, form the baseline limits of the playing area 10. In order to meet the requirements stipulated by tennis federations, the playing area needs to have a length of 23.77 meters and a width of 10.97 meters.

When playing tennis, the players position themselves on either side of the net 2, generally in the playing area 10 or behind the court baselines 112 and 114, and mainly face in a direction substantially parallel to the main axis 100 of the court.

The surface 1 of the court has a rectangular shape, of which the sides are parallel to the limits of the playing area 10. In order to meet the requirements stipulated by tennis federations, this surface preferably has a length of 36 meters and a width of 18 meters. This surface 1 is surrounded by a fence 3, formed by a mesh 35 supported by fence posts 30 (only some of these posts 30 are numbered in the drawings) surrounding the four sides of the surface 1 of the court.

The posts 30 that are aligned in parallel with the lateral limit 111 of the playing area, on the same side of the main axis 100, form the side fence 31. The posts 30 that are aligned in parallel with the court baseline 112 of the playing area 10, on the same side of the net 2, form the baseline fence 32. The posts 30 that are aligned in parallel with the lateral limit 113 of the playing area, on the same side of the main axis 100, form the side fence 33. The posts 30 that are aligned in parallel with the court baseline 114 of the playing area, on the same side of the net 2, form the baseline fence 34.

In order to meet the requirements stipulated by tennis federations, each of the side fences (31 and 33, respectively) is generally located at a distance of 3.5 meters from the closest lateral limit (111 and 113, respectively). Likewise, each of the baseline fences (32 and 34, respectively) is generally located at a distance of 6 meters from the closest court baseline (112 and 114, respectively).

Figure 3:
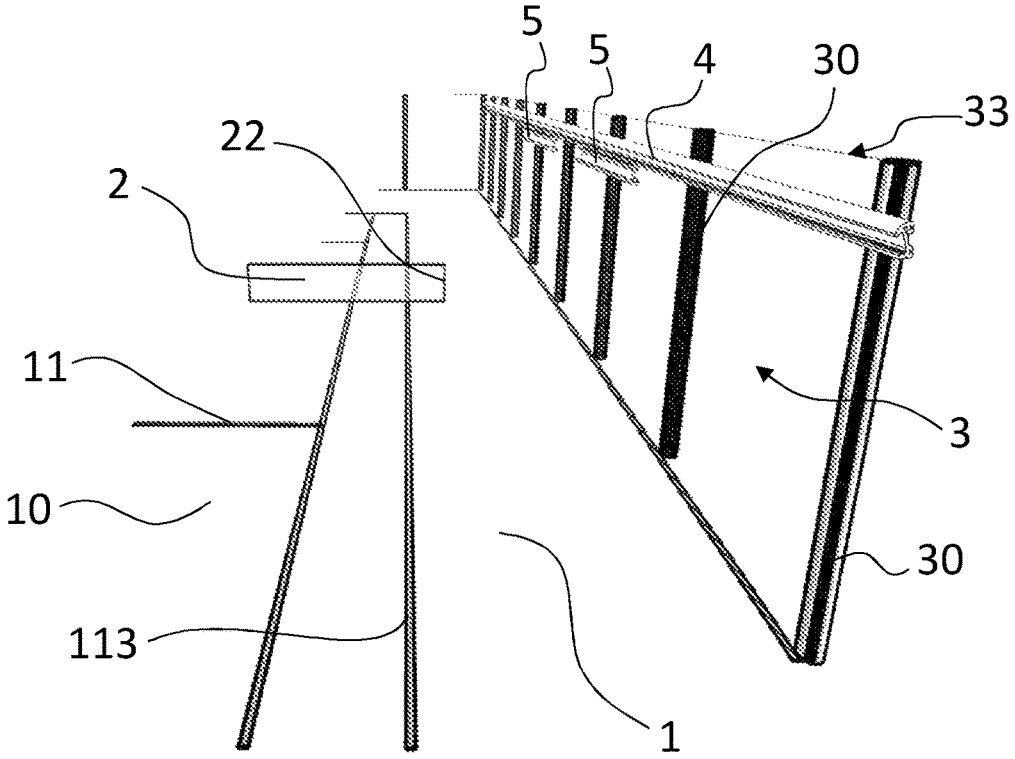
FIG. 3 is a perspective view of a detail showing a side fence of the court from FIG. 2.

FIG. 3 shows the side fence 33 in more detail. As this figure shows, the posts 30 holding the mesh 35 in order to form to the fence 3 are aligned at regular intervals. Conventionally, these posts are spaced apart from one another at a distance of between 3 meters and 3.6 meters. Of course, a gate (not shown in the drawings) is normally provided in this fence.

In order to meet the requirements stipulated by tennis federations, the fence 3 extends vertically over a height of at least 3 meters, generally between 3 meters and 3.50 meters. To support this fence, the posts 30 therefore extend vertically over a height of at least 3 meters.

Lighting Device

Figure 2:
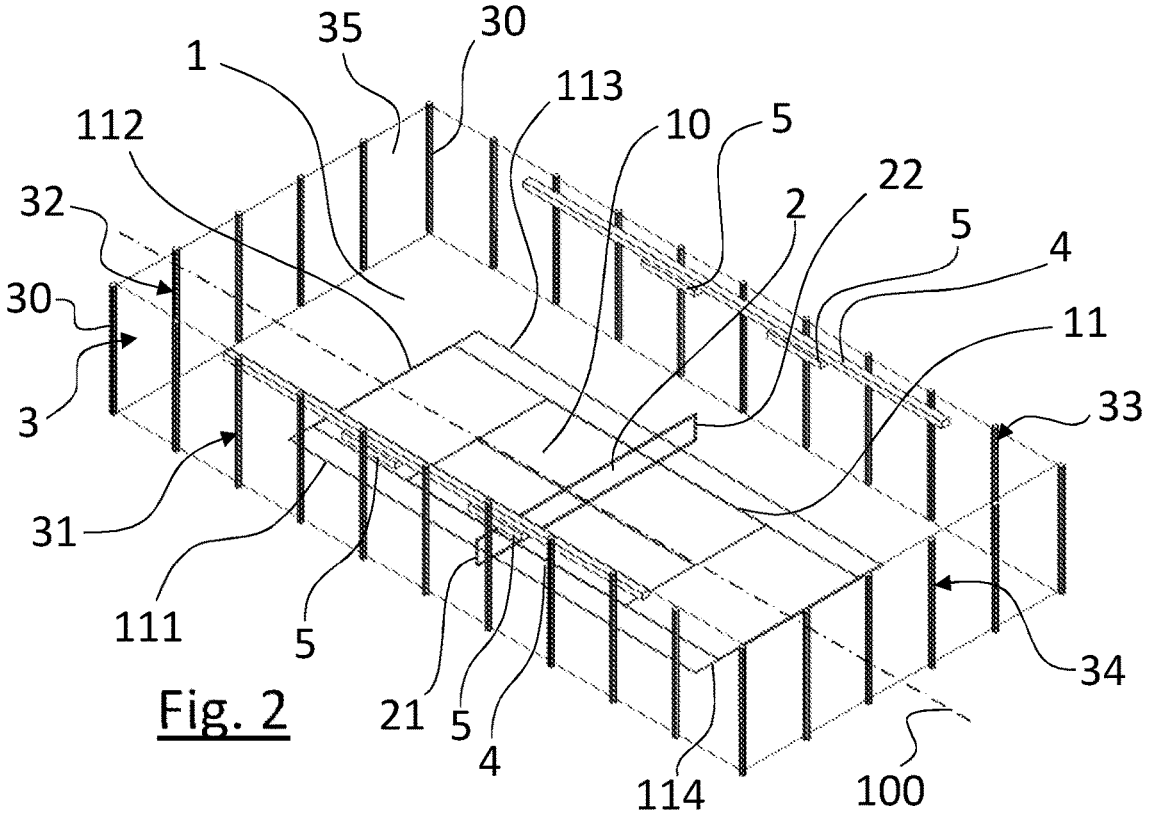
FIG. 2 is a perspective view of the court from FIG. 1.

The tennis court shown in FIGS. 1 and 2 is equipped with a lighting device according to an embodiment of the invention, comprising two main lighting strips 4 and four secondary lighting strips 5. The side fence 31 and the side fence 33 each support a main lighting strip 4, which is mainly intended to light the playing area 10, and two secondary lighting strips 5, which are mainly intended to light the balls when they are moving through the air at a height.

This lighting of the court by two strips 4 positioned on either side of the court also makes it possible to significantly limit the shadows cast by the players on the court, which may distract the players or spectators.

Main Lighting Strips

The main lighting strips 4 extend horizontally along the majority of the length of the side fences 31 and 33. More specifically, in the embodiment shown, these main lighting strips 4 extend over a length of 30.4 meters of the side fences 31 and 33, of which the total length is 36 meters. This length allows the main lighting strips 4 to face one another over the entire length of the playing area 10, which measures 23.77 meters.

Each main lighting strip 4 has a longitudinal shape and is attached to the posts 30, on the sides of the posts facing the court, at a height of 3 meters. The posts 30 normally have a height of between 3 meters and 3.50 meters, and the main lighting strips 4 are therefore fixed close to the upper end thereof.

Figure 4:
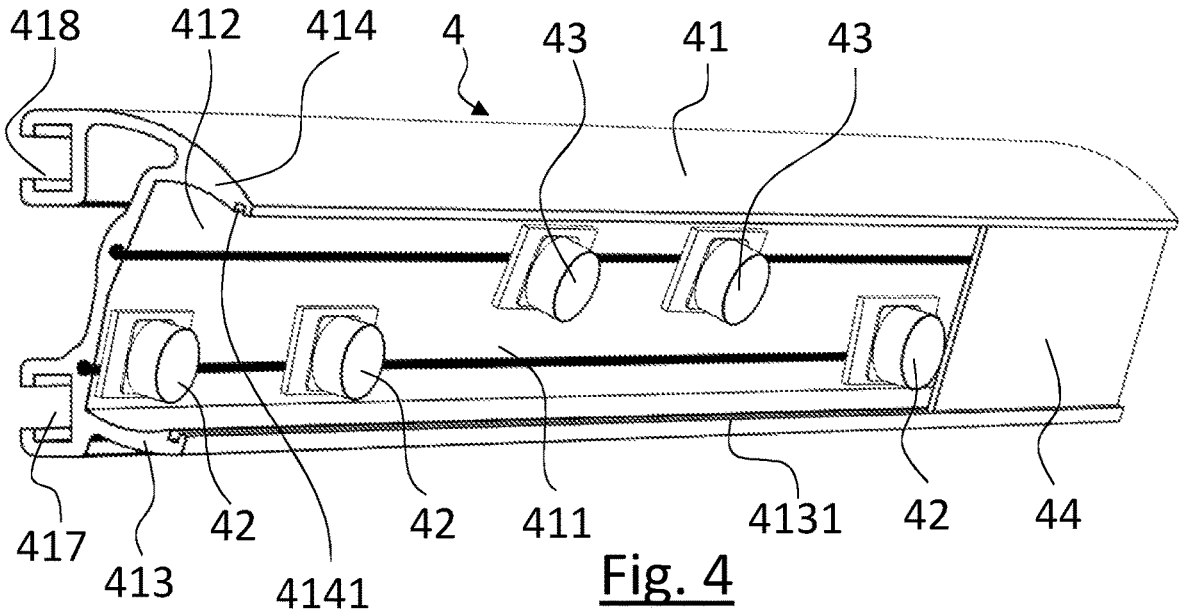
FIG. 4 is a perspective view of a portion of the main lighting strip supported by the fence from FIG. 3.
Figure 5:
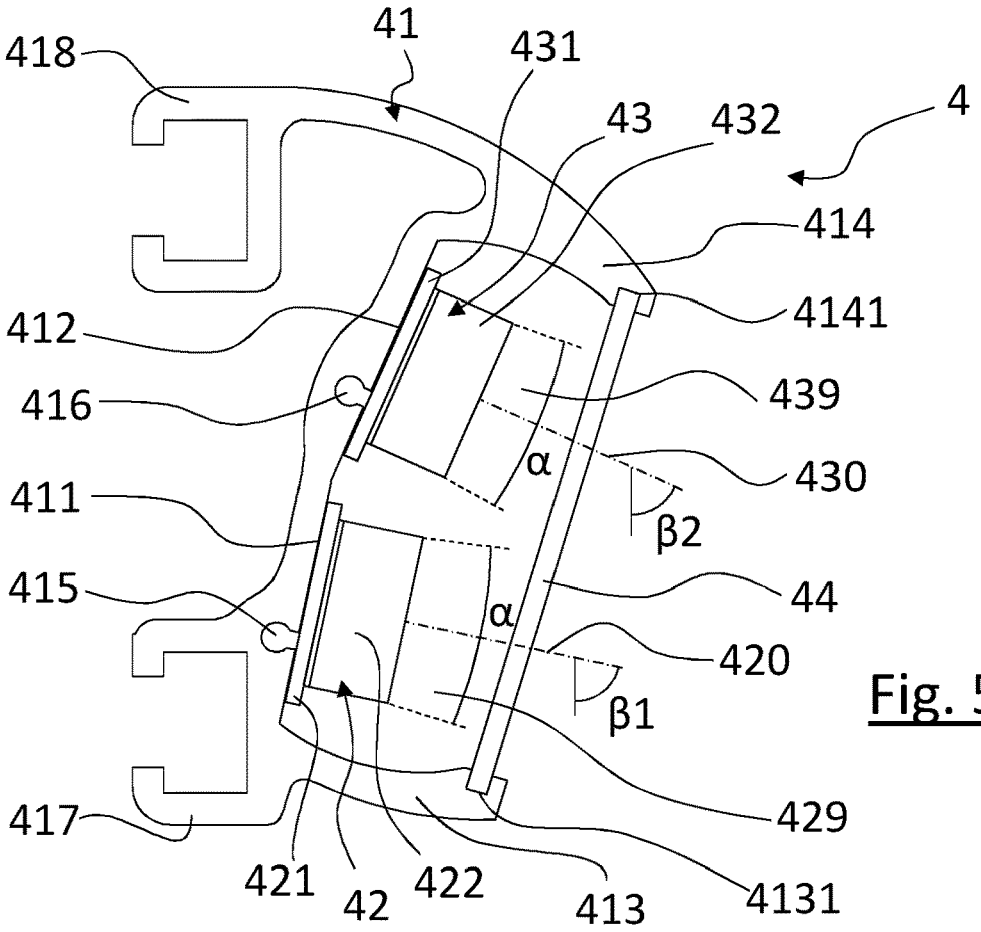
FIG. 5 is a sectional view of the main lighting strip from FIG. 4.

FIGS. 4 and 5 show, in a perspective view and a sectional view, respectively, a portion of the main lighting strip 4. This lighting strip comprises a profile member 41, made of aluminum in the embodiment shown, which is designed to be fixed to the posts 30 and to support lighting means. This profile member 41 comprises two rails, a lower rail 417 and an upper rail 418, extending over the entire length thereof and having a shape suitable for retaining the head of a screw of which the threaded portion extends outside the profile member. These two rails 417 and 418 are intended to be in contact with a vertical post. Their alignment therefore defines the vertical direction when the main lighting strip 4 is in a configuration for use.

The profile member 41 also defines a lamp support housing, which is formed between two contiguous surfaces for supporting lamps 411 and 412 and two protective wings, a lower wing 413 and an upper wing 414, respectively. These two wings each extend from an edge of the lamp support surfaces, 411 and 412, respectively, substantially perpendicularly to these walls. The free ends of these wings 413 and 414 have grooves, 4131 and 4141, respectively, that make it possible to retain a translucent polycarbonate wall 44 that closes the lamp support housing (in FIG. 4, the wall 44 is only shown over part of the length of the strip 4).

Lamps, preferably based on LED (light-emitting diode) technology, are positioned in the housing that is thus formed, at several points on the main lighting strip 4. Some of these lamps, called "distant lighting lamps" 42, are fixed to the support surface 411. The other lamps, called "close lighting lamps" 43, are fixed to the support surface 412.

Advantageously, these lamps 42 and 43 are bonded to the support surfaces 411 and 412 by means allowing heat transfer between the lamps and the profile member 41. The profile member 41, which is preferably metal, may thus also participate effectively in dispersing the heat produced by the lamps.

In the embodiment shown, the distant lighting lamps 42 and the close lighting lamps 43 are identical. They may, however, be different in other embodiments. These lamps 42 and 43 are constituted by an electronic card, 421 and 431, respectively, a planar surface of which is intended to be bonded to a support and the other surface of which has a light-emitting diode (not shown in the drawings) covered by an optical unit, 422 and 432, respectively. These optical units 422 and 432 act as a lens which focuses the light emitted by the diodes into a light beam.

According to a particular embodiment (not shown in the drawings), part of the lamp support housing may be covered with resin, in order to protect the lamps from dust and water. In this case, the resin covers the base of each of the lamps, and in particular the electronic card 421 or 431, and the base of the optical unit 422 or 432. By contrast, the portion of the optical unit emitting the light beam is not covered with resin. In this particular embodiment, it is not necessary to close the lamp support housing with a translucent wall 44, since the lamps are sufficiently protected by the resin.

Orientation of the Light Beams

In the embodiment shown, the optical units, 432 and 432, respectively, form a highly directional conical light beam, shown by dashed lines in FIGS. 5, 429 and 439, respectively, having a diffusion angle $\alpha=11°$. In the present application, the diffusion angle is the diffusion angle of the full width at half maximum (FWHM) of the beam, i.e., the width of the beam at which the light intensity is at least equal to the maximum intensity. Other types of beam may be used, but, to avoid the risk of dazzling or flashes of light, it is necessary for the diffusion angle of the beams to be less than 20°. A diffusion angle of less than 15°, and preferably of between 10° and 12°, makes it possible both to effectively prevent dazzling or flashes of light and to produce optimal distribution of the lighting over the court.

The optical units 422 and 432 are designed to direct the beams, 429 and 439, respectively, in a direction, 420 and 430, respectively, perpendicular to the planar surface of the electronic cards 421 and 431, and therefore perpendicular to the support surfaces, 411 and 412, respectively, of the profile member 41. These support surfaces 411 and 412 have selected orientations, depending on the court to be lit, of the lamps used and of the position of the strip relative to the court, in order to provide uniform distribution of the light over the court.

In the embodiment shown, the orientation of the surfaces 411 and 412 is selected for the case of a strip that comprises the above-described lamps and is positioned at a height of 3 meters on the fence posts of the tennis court to be lit. The surface 411 has an orientation such that the beam emitted by the distant lighting lamps 42 is oriented in the direction 420, forming an angle $\beta 1$ that is equal to 78° with the vertical, when the strip 4 is in its configuration for use. The surface 412 has an orientation such that the beam emitted by the close lighting lamps 43 is oriented in the direction 430, forming an angle $\beta 2$ that is equal to 66° with the vertical, when the strip 4 is in its configuration for use. In any case, the beams are oriented in directions perpendicular to the longitudinal direction of the strip 4, therefore perpendicular to the main axis 100 of the court.

Figure 6:
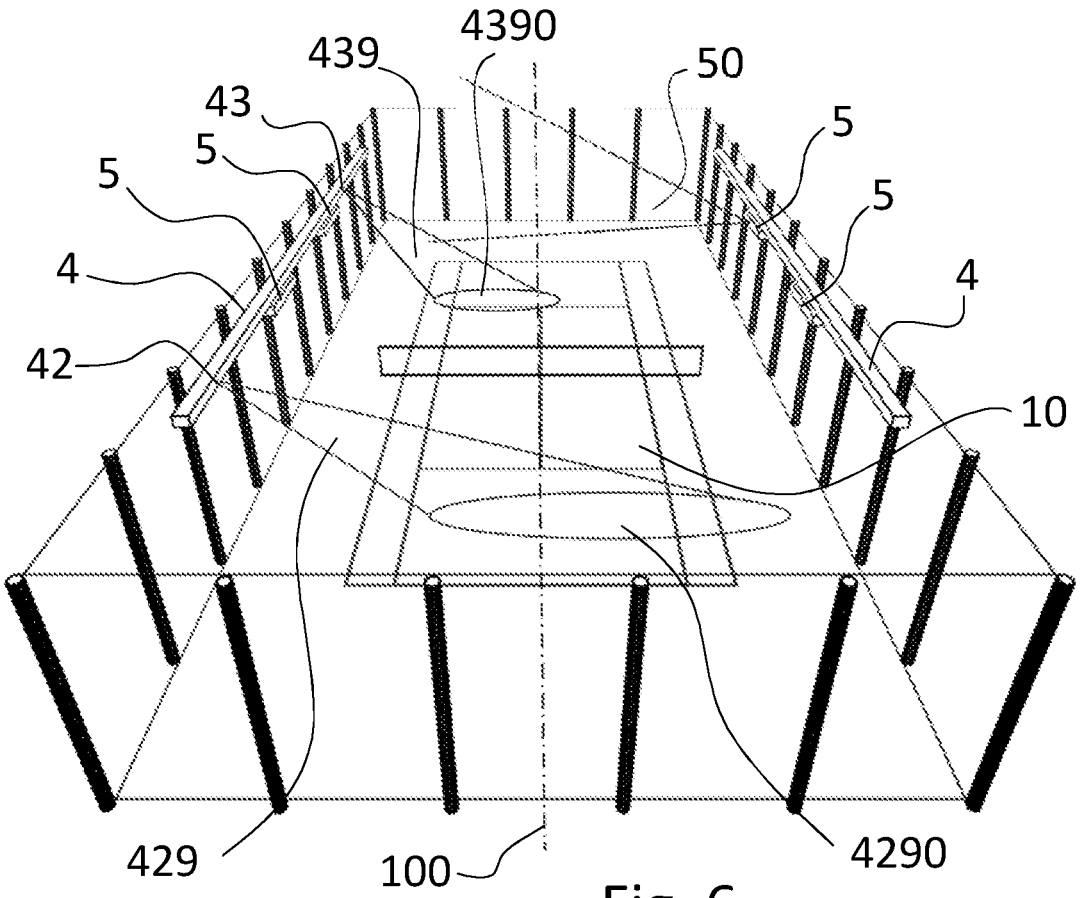
FIG. 6 is a perspective view of the court from FIG. 1, showing the lighting provided by some of the lamps of the lighting strips.

FIG. 6 shows the lighting produced by a distant lighting lamp 42 and a close lighting lamp 43 of one of the strips 4 over the tennis court. This figure shows the light beam 439 and the light spot 4390 produced on the court by a single close lighting lamp 43. This lamp 43 only lights a restricted portion of the playing area 10, which is located immediately opposite the lamp 43 and extends in a direction perpendicular to the main axis of the court 100. A player moving around on the playing area 10 does not risk having the light beam 439 in their eyes, and therefore does not risk being dazzled or subjected to a flash of light, unlike when they are positioned on the far edge of the playing area 10 and are oriented towards this lamp, therefore perpendicularly to the main axis 100. This situation is extremely rare when playing tennis.

FIG. 6 also shows the light beam 429 and the light spot 4290 produced by a single distant lighting lamp 42. Since the lamp 42 is oriented in a direction closer to the horizontal than the lamp 43, the light spot 4290 is further from the strip 4, and therefore is wider and more diffuse. Owing to the high level of directivity of the beam 429, this spot 4290, however, extends in a direction perpendicular to the main axis of the court 100 and remains limited to a small portion of the length of the playing area 10, located immediately opposite the lamp 42. A player moving around on the playing area 10 does not risk having the light beam 429 in their eyes, and therefore does not risk being dazzled, unlike when they are positioned in the region of the edge of the playing area 10 and are oriented towards this lamp, therefore perpendicularly to the main axis 100. This situation is very rare when playing tennis.

The beams produced by the lamps 42 and 43 supported by the strips 4 therefore can only dazzle a player in very rare cases when playing tennis.

Distribution of the Lamps

As shown in FIG. 4, lamps 42 and 43 are positioned at substantially regular intervals in the strip 4.

In the embodiment shown, the strip 4 has, over its length, one lamp 42 or 43 approximately every 12 cm, by alternating series of two close lighting lamps 43 and six distant lighting lamps 42. The inventors have determined that this distribution of the lamps, having the features, lamp orientations and positions of the strips set out above, would make it possible to achieve excellent distribution of the lighting over an outdoor tennis court which satisfies the standards set by tennis federations for the organization of outdoor competitions. Moreover, this regular distribution of the lamps makes it possible to generate a lighting line that is virtually continuous all the way along the strip 4.

It is possible, however, without departing from the scope of the invention, to implement one or more strips that each have one or more surfaces oriented at different angles and supporting lamps having different properties in order to adapt to different configurations, for example to the lighting of a court other than a tennis court, or a lighting system in which the strips are placed in a different position relative to the court.

Secondary Lighting Strips

The lighting device shown comprises, in addition to the two main lighting strips 4, four secondary lighting strips 5 extending in parallel with the main lighting strips 4. It should be noted that, in other embodiments of the invention, the lighting device may only comprise one strip, or one or two lighting strips on each side of the court, or, by contrast, a greater number of strips. In the embodiment shown in the drawings, two secondary lighting strips 5 are positioned below each of the main lighting strips 4. Each of these secondary lighting strips 5 measures 1.90 meters in length, and is attached in a centered manner to one of the posts 30 adjacent to the posts 30 closest to the net 2. Therefore, on each side of the court, two secondary lighting strips 5 are separated from one another by several meters, with each one being positioned on one of the sides of the net 2.

These secondary lighting strips 5 have a structure that is very close to that of the main lighting strips 4. They also comprise profile members, comprising fixing rails and lamp support housings in which a lamp support surface or a plurality of surfaces having different orientations are provided to support the lamps.

In the embodiment shown, the secondary lighting strips 5 are formed from the same profile member 41 as the main lighting strips 4. This profile member is, however, positioned in a reverse position, with the wing 413 being positioned upwards and the wing 414 being positioned downwards. The lamp support surfaces of this profile member therefore have different orientations.

In this embodiment, only the surface 411 of the profile member 41 forming each secondary lighting strip 5 supports lamps. These lamps therefore emit a beam 50 that is oriented in a direction perpendicular to the main direction of the court and forms an angle of 102° to the vertical. The lamps used in this embodiment have a diffusion angle of 30°, which is much higher than the diffusion angle of the lamps implemented in the main lighting strips 4. They may, however, have different properties in other embodiments.

The beam 50, which is shown in FIG. 6 for one of the lamps of one of the strips 5, is therefore directed in a slightly upward direction. This beam makes it possible to effectively light high balls when playing tennis. Of course, each of the strips 5 has a series of lamps over its length, such that the entirety of the region located above the area of the court through which high balls are likely to pass is uniformly lit. The orientation of the beams produced by this secondary lighting strip 5 means that, in the majority of cases, the lighting remains above the players' heads. In the rare cases in which the player may be in the light beams from these strips 5, these beams are highly dispersed and therefore do not risk dazzling them or causing them to experience a flash of light.

Installation of the Lighting Device

The lighting device shown in the drawings can be installed very easily on a tennis court. Each of the strips 4 is made up of a plurality of segments, which are each completely equipped with lamps and the translucent wall. By way of example, each strip 4 is made up of eight segments of 3.80 meters each. This length of the segments, which is greater than the distance that is generally observed between two successive fence posts 30, allows each of the segments to be rigidly connected to at least one of the posts 30.

Figure 8:
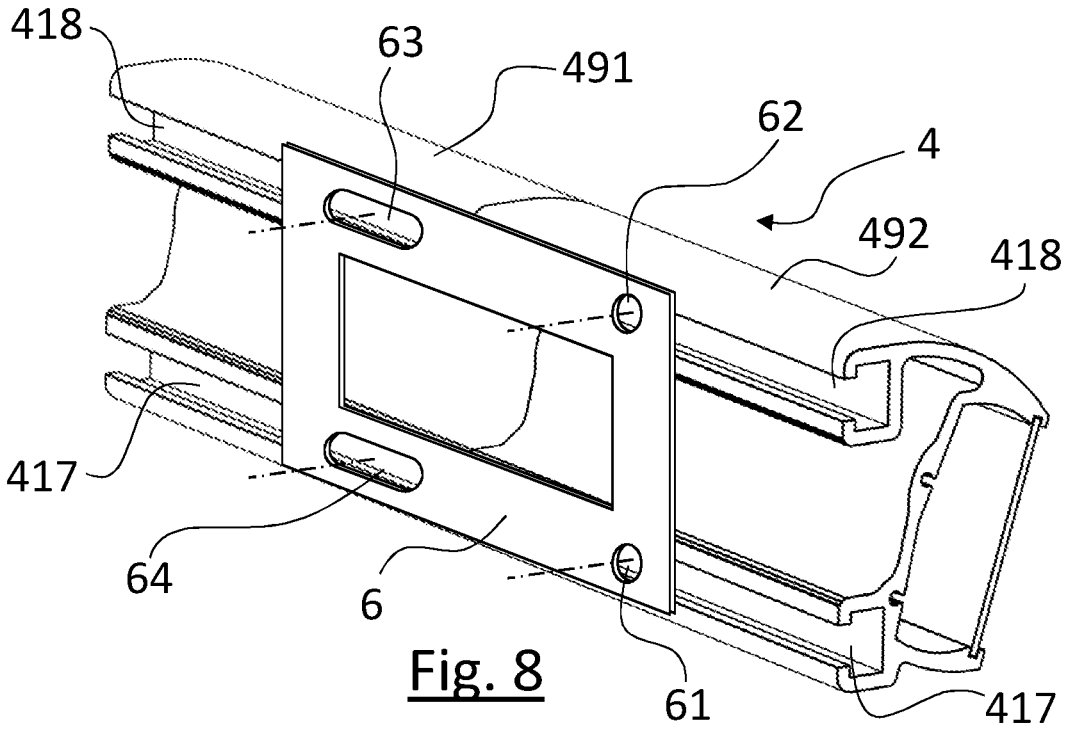
FIG. 8 is a perspective view of the means for fixing two segments of the main lighting strip from FIG. 4.

The different segments forming the same strip can be easily joined, as shown in FIG. 8. This figure shows the ends of two segments 491 and 492 of a strip 4, which are rigidly connected by means of a connecting plate 6. This plate 6, which is positioned against the lower rails 417 and upper rails 418 of each of the segments 491 and 492, has holes 61, 62, 63 and 64 that are each positioned opposite each of the two rails of each segment. This plate 6 may be rigidly connected to the two segments 491 and 492 by means of bolts, the screw heads of which are introduced into the rails 417 and 418 and the shaft of which passes into the holes 61, 62, 63 and 64 in the plate 6. The hexagonal screw heads, which are inserted into the rails 418 and 417, are advantageously blocked from rotating by the rails, in order to allow the nuts to be locked. It should be noted that the holes 63 and 64 have oblong shapes that make it possible to move the bolts along the rails 417 and 418, in order to prevent any potential contact between the bolts and a fence post 30.

Figure 7:
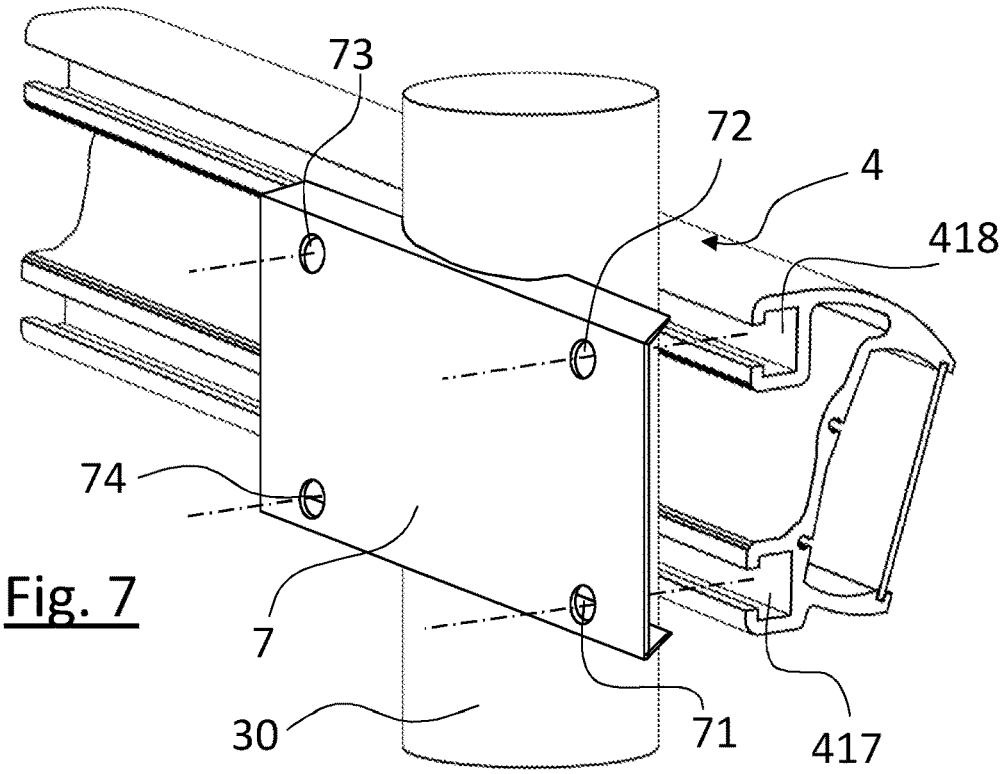
FIG. 7 is a perspective view of the means for fixing the main lighting strip from FIG. 4 to a fence post.

Owing to the relatively low weight thereof, once joined, the strips can be easily raised and fixed to the fence posts 30 at a height of 3 meters. FIG. 7 shows the joining of a portion of the strip 4 to a fence post 30. This joining takes place by means of a fixing plate 7, which is positioned against the post 30 on the side opposite the strip 4. This fixing plate 7 has a shape suitable for bearing against the post 30, and has four holes 71, 72, 73 and 74. This plate 7 may be brought closer to the strip 4 by gripping against the post 30, due to bolts of which the screw heads are introduced into the rails 417 and 418 and of which the shaft passes into the holes 71, 72, 73 and 74.

The mechanical mounting of the strips 4 and 5 may thus be carried out very easily by simply assembling bolts without there being any need for cutting or drilling There is no need for a mast to be erected, as the pre-existing fence posts are used. It can therefore be carried out rapidly and for a much lower cost, by persons who do not have any particular qualifications.

Each of the sections of the strip 4 comprise a set of electrical wires (not shown in the drawings), which allow each of the lamps to be supplied with power. According to an advantageous feature, each segment of the strip 4 has, at each of its ends, a single power connector, which can be connected to the corresponding connector of the adjacent section. The electrical power wires in each of the sections can therefore be joined to one another very easily.

At one end of each of the strips 4 and 5, the power connector can be connected to a power cable, which makes it possible to supply the electrical power generated by a power supply box that can be positioned at the bottom of the fence 3. Such a power supply box, which makes it possible to supply power to all the lamps in one or more strips 4 or 5, can be connected to the standard electrical grid. The lighting of the court by highly directional LED lamps that are located a short distance from the court to be lit consumes relatively little power. The power consumed is, in particular, much lower than the power consumed by spotlights positioned at the top of masts, because of the short distance between the light sources and the surface to be lit.

A closure cap or flange can be joined to each end of the strips in order to close the lamp support housing. This cap or flange can advantageously be fixed by screws which are inserted into the holes 415 and 416, which are provided in the profile member 41 for this purpose.

In a particularly advantageous manner, the lighting device according to the invention does not require any adjustment after installation. Therefore, in the embodiment shown, if the strips are placed in the position recommended by the manufacturer (at a height of 3 meters on the side fences of the tennis court for the main lighting strips 4) and the tennis court to be lit has the dimensions prescribed by tennis federations, the orientation of the different lamps will be immediately suitable for lighting the court in an optimal manner without any adjustment. In the above-described embodiment, the form of the strips also prevents any adjustment of the orientation of the lamps. The installation of the lighting device is therefore particularly simple.

Device for Lighting Other Courts

In the above-described embodiment, the lighting device is suitable for lighting a tennis court. Of course, other lighting devices according to the invention can be easily implemented for lighting other types of courts, for example courts intended for playing other sports. The implementation of the invention on other courts is particularly advantageous when these courts have standardized dimensions that allow the manufacturers to propose devices that are suitable for lighting courts without any adjustment.

The use of highly directional lamps that are oriented perpendicularly to the main axis of the court is also particularly advantageous for lighting courts on which the athletes or players mainly face along the main axis of the court and do not want to be dazzled by the lighting.

Without departing from the scope of the invention, a person skilled in the art would easily find variants of the solutions set out in the above embodiments, for example for fixing strips to the posts or fixing strip segments to one another, for positioning lamps in the strips in the selected angular positions, etc.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A device for lighting a court surrounded by a fence, including posts, having a height of between 3 meters and 3.5 meters, the device comprising at least one lighting strip extending horizontally along at least one side of said court, wherein said strip is fixed on said fence, has a length extending in a longitudinal direction and comprises a series of light sources distributed along the length, each of said light sources projecting a light beam oriented perpendicularly to the longitudinal direction of said strip and in a direction having an angle of less than 25° to horizontal, each light beam having a diffusion angle that is less than 20°.

2. The lighting device according to claim 1, wherein said strip extends over a majority of a length of said side of said court, at a predefined height relative to said court.

3. The lighting device according to claim 1, further comprising at least two lighting strips, facing one another along two opposite, parallel sides of said court.

4. The lighting device according to claim 1, wherein an orientation of said light sources relative to said at least one strip is invariable.

5. The lighting device according to claim 1, wherein a position of said at least one strip relative to the court is predetermined based on dimensions of said court and properties of the desired lighting.

6. The lighting device according to claim 1, wherein said strip or at least one of said strips has means for fixing to posts located along said side of the court.

7. The lighting device according to claim 1, wherein said fixing means comprise rails which extend over the entire length of said strip and are suitable for holding a fixing element at any point along the length of said strip.

8. The lighting device according to claim 7, wherein said at least one strip is formed by a plurality of separate strip segments which are joined to one another by fixing elements held by said rails of each of said strip segments.

9. The lighting device according to claim 1, wherein the light sources of said at least one strip are oriented in at least two different directions.

10. The lighting device according to claim 9, wherein said at least one strip has at least two separate supports suitable for receiving each of the light sources that are oriented in parallel in a predetermined direction.

11. The lighting device according to claim 10, wherein each of said supports extends over an entire length of said at least one strip.

12. The lighting device according to claim 6, wherein said at least one strip comprises a metal profile member comprising said fixing means and at least one planar surface forming a support that is suitable for receiving light sources that are oriented in parallel in a predetermined direction.

13. The lighting device according to claim 1, further comprising at least two lighting strips that extend substantially in parallel with one another along the same side of said court, the light sources of at least two of said strips being oriented in different directions, which are perpendicular to the longitudinal direction of said strips.

14. A lighting strip configured to be implemented in a lighting device, wherein the lighting strip has fixing means configured to allow the lighting strip to be fixed in a horizontal position to posts, said fixing means comprising rails which extend over an entire length in a longitudinal direction of said strip and are suitable for holding a fixing element at any point along the length of said strip, and wherein the lighting strip comprises a series of light sources distributed along the length of the strip, each of said light sources projecting a light beam oriented perpendicularly to the longitudinal direction of said strip and in a direction having an angle of less than 25° to horizontal, each of said light beams having a diffusion angle that is less than 20°, some of said light sources having a first, non-modifiable orientation relative to said strip, and a remainder of said light sources having a second orientation, which is different from said first orientation and is non-modifiable, relative to said strip.

* * * * *